United States Patent [19]

Drayer et al.

[11] 4,161,622

[45] Jul. 17, 1979

[54] INSULATOR ASSEMBLY HAVING NOVEL FEEDTHROUGH PORTION

[76] Inventors: Sanford A. Drayer, 1270 Village Way, Orlando, Fla. 32807; Gordon D. Wampler, 11411 NW. 30th St., Sunrise, Fla. 33323

[21] Appl. No.: 753,211

[22] Filed: Dec. 22, 1976

[51] Int. Cl.[2] ..... H01B 17/26

[52] U.S. Cl. ..... 174/152 R; 339/126 R

[58] Field of Search ..... 174/152 R, 153 R; 339/126 R, 214 R, 214 C

[56] References Cited

U.S. PATENT DOCUMENTS

| | | | |
|---|---|---|---|
| Re. 22,086 | 4/1942 | Treanor | 174/152 R |
| 685,507 | 10/1901 | Davis | 174/152 R X |
| 1,470,993 | 10/1923 | Loundagin | 174/152 R |
| 1,956,357 | 4/1934 | Leib | 174/152 R |
| 2,439,394 | 4/1948 | Lanzalotti et al. | 174/153 R |
| 2,443,545 | 6/1948 | Schwennesen | 174/153 R X |

FOREIGN PATENT DOCUMENTS

| | | | |
|---|---|---|---|
| 136206 | 2/1950 | Australia | 174/153 R |
| 494221 | 7/1953 | Canada | 339/126 R |
| 724680 | 9/1942 | Fed. Rep. of Germany | 174/152 R |
| 1041123 | 10/1958 | Fed. Rep. of Germany | 174/152 R |
| 1088576 | 9/1960 | Fed. Rep. of Germany | 174/152 R |
| 667229 | 2/1952 | United Kingdom | 174/153 R |
| 789471 | 1/1958 | United Kingdom | 174/152 R |

*Primary Examiner*—Laramie E. Askin
*Attorney, Agent, or Firm*—Julian C. Renfro

[57] ABSTRACT

An insulator assembly for use in assisting the transfer of electrical power from one side to the other of a bulkhead or panel having a hole therein. The assembly uses a basic insulator device having a body portion as well as an upstanding feedthrough portion, with the upstanding portion being of a size so as to extend through a hole in the bulkhead or panel. The upstanding member is provided with a hole therethrough in which a current-carrying member is secured. Such current-carrying member forms the support for at least one connector means on the upstanding member, and at least one connector means on the body portion, thereby facilitating connection to a current-carrying member located on each side of the bulkhead.

1 Claim, 6 Drawing Figures

INSULATOR ASSEMBLY HAVING NOVEL FEEDTHROUGH PORTION

BACKGROUND OF THE INVENTION

In the past, manufacturers of electrical heaters or the like have dealt with the problem of supplying electrical power to the filaments of the heater by employing threaded studs that pass through holes in the sheet metal housing of the heater. Grounding is prevented by disposing these studs in a pair of abutting insulators, referred to as male and female insulators, with one insulator portion disposed on the outside of the housing and the other insulator half on the inside of the housing.

At the time of initial assembly, the stud, with one insulator portion located thereon, is passed through a somewhat enlarged hole in the housing, and then the other insulator half is applied from the other side of the housing. A nut and washer are then placed on each end of the stud, to mechanically secure the insulators in place on the housing. Thereafter, electrical assembly of the heater is completed by forming an eyelet in the end of the filament wire or the end of the power wire to fit around the stud. A spade or ring type terminal could be crimped onto the wire ends. After placing the eyelet or terminal onto the stud, a washer and nut are then placed onto the stud and securely tightened. This procedure is repeated on the opposite end of the stud. If parallel wiring to elements is required, two power wires would be required on the one end of the stud.

Although countless numbers of such devices have been used through the years, these assemblies suffer from a large number of disadvantages. First of all, a considerable amount of labor is involved in selecting out the stud, nuts that will threadedly fit on the stud, and a suitable number of lock washers to prevent undesired rotation. Then, at the time of assembly, the worker must bring these components together with eyelets or spade terminals so that the desired electrical relationships can be accomplished.

It is significant to note that this is necessarily a time consuming procedure, requiring the services of a dextrous worker if prohibitively high labor costs are to be avoided. It is also most important to note that a preassembled unit cannot be utilzed inasmuch as the hole in the housing is smaller than the external dimensions of the assembly, so any preassembly of the components onto the stud must be disassembled at the time the actual assembly into place in the housing of the heater or the like is to be brought about.

Other disadvantageous aspects of these prior art devices come to light when heater repair is to be effected, for at such times it is necessary to disassemble two complete male-female assemblies for each defective filament to be replaced. It is therefore to be seen that even the labor associated with the repair of heaters can be considerable because of the painstaking effort involved. Furthermore, if the heater is several years old, the threaded stud may have rusted, making removal of the nuts difficult, which, in turn, jeopardizes the easily cracked male-female insulator portions.

SUMMARY OF THIS INVENTION

In accordance with this invention, we have provided a novel insulator device which can be electrically and mechanically preassembled at the factory, placed as an assembly into a suitable mounting hole in the housing of a heater or the like, and then secured in position by a single sheet metal screw. Because there is no painstaking threading of insulator, lock washer, and other components onto a threaded stud, at no time is the assembly worker dealing with single components, and because the assembly of all components in the desired relationship was able to be accomplished beforehand, it is not necessary to use a threaded stud, which must be made from expensive material if rusting is to be prevented. Otherwise, the field worker may encounter substantial disassembly problems.

Our novel insulator connector assembly features a consistently reliable electrical through-path for the sizable currents flowing into the heater with which out device may be used, and should removal of the assembly ever be necessary, such as for filament replacement reasons, this conductivity of our device remains unaltered.

The basic insulator device has a body portion as well as an upstanding feedthrough portion, with the upstanding portion being of a size so as to extend through a hole in a bulkhead. The upstanding member is provided with a hole extending therethrough, in which a current carrying member is secured, with the current carrying member serving as the support for at least one connector means on the upstanding member, and at least one connector means on the body portion. In this way our device provides a ready assembly for facilitating the rapid connection of a current carrying member to conductors located on opposite sides of a bulkhead.

Preferably, the connector means used on each end of the current carrying member is a connector tab, such as a "Faston" tab, thus making it possible for power leads as well as filament leads to be rapidly connected to the ends of the assembly. This latter is of course accomplished by the use of appropriate mating tab receptacles, such as "Faston" tab receptacles. Because of this arrangement, the removal and thereafter reinsertion of power leads is rapid, and only the burned out filament need be disconnected from the respective tab assembly. This is of course to be contrasted with the ponderous procedure previously necessitated in the field, for at such time it was necessary to completely disassemble all components of the prior art feedthrough arrangement used.

The numerous advantages flowing from the use of our device are made possible by utilizing an insulator assembly having an upstanding feedthrough portion that is to be inserted through a suitable hole in a bulkhead of a heater or the like. This upstanding portion, also referred to as a feedthrough post, carries at the end remote from the body portion, a tab onto which a complementary receptacle carried on the filament is to be received, with this tab being secured on the post mechanically as well as electrically by an elongate, currentcarrying eyelet that passes through the entire thickness of the upstanding feedthrough portion of the insulator member.

The upstanding feedthrough member is maintained at the desired location in the sidewall of the housing easily, such as by the use of a sheet metal screw passing through a simple hole in the base or body portion of the insulator member, and then engaging a small hole somewhat offset with respect to the hole in the housing through which the feedthrough member passes. However, inasmuch as rotation of the ceramic member in the housing is highly undesirable, we in a preferred embodiment of our invention supplement the function of the sheet metal screw by constructing the feedthrough portion of a cross-sectional configuration other than round, for in such instance, rotation of the ceramic member in the hole in the housing cannot take place.

It is a primary object of our invention to provide a novel insulator member usable in electrical devices and having an upstanding feedthrough member capable of being inserted in a hole in a panel such that electrical current may be carried through the panel by suitable conductor members without the risk of grounding to the panel.

It is another object of our invention to provide a ceramic insulator member of unique construction such that electrical components carried on the insulator member may effect the transfer of electrical power through a panel without the danger of grounding to the panel.

It is yet another object of our invention to provide a novel insulator member having an upstanding feedthrough portion, with a hole located through such feedthrough portion into which may be disposed a current carrying member, the latter member serving to enable electrical power to be conducted from a base portion of such device to the end of the upstanding feedthrough portion, in a completely insulated manner.

It is still another object of our invention to provide a novel insulator assembly having an upstanding feedthrough portion into which electrical components may be preassembled, thus obviating the need for a worker to assemble discrete components on the two sides of a panel at the time electrical power is to be transmitted therethrough.

DETAILED DESCRIPTION

Figure 1:
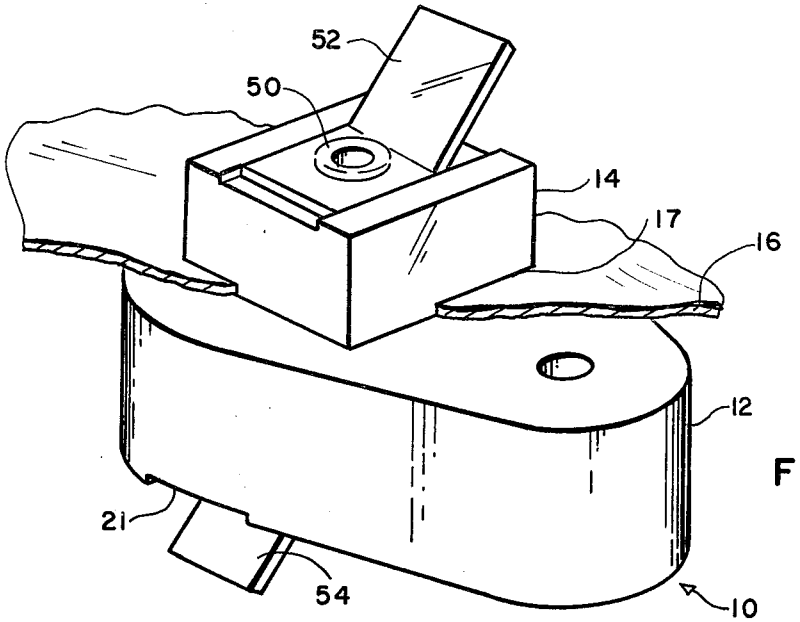
FIG. 1 is a perspective view of our novel insulator assembly in an operative relationship to a bulkhead or panel, with part of the bulkhead broken away in the interests of clarity.

Turning to FIG. 1, it will there be seen that we have provided a typical insulator 10 in accordance with this invention, principally involving ceramic base portion 12 and ceramic feedthrough portion 14. The members 12 and 14 are of integral construction, with the ceramic used preferably being Steatite L-3.

It is to be understood that the upper surface of the ceramic base portion 12 is to be placed against a plate or panel 16, with the upstanding feedthrough portion 14 extending through a hole 17 in the panel so as to enable electric power to be carried through the panel in the manner to be described at greater length hereinafter.

Figure 2:
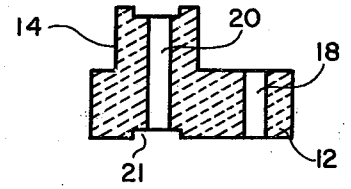
FIG. 2 is a cross-sectional view of our novel insulator member, shown to a smaller scale.
Figure 3:
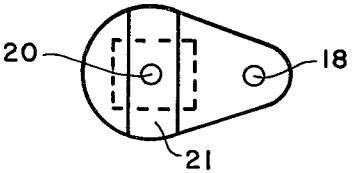
FIG. 3 is a bottom view of the insulator member of FIG. 2.

FIG. 2 is a cross-sectional view revealing that the insulator member contains a pair of holes, with a hole 18 being disposed so as to extend through the base portion, and an elongate hole 20 disposed at a location essentially corresponding to a central portion of the upstanding feedthrough portion 14. FIG. 3 further reveals the placement of holes 18 and 20 and also reveals a slot 21 extending across the bottom of the device for a purpose to be later described.

Figure 4:
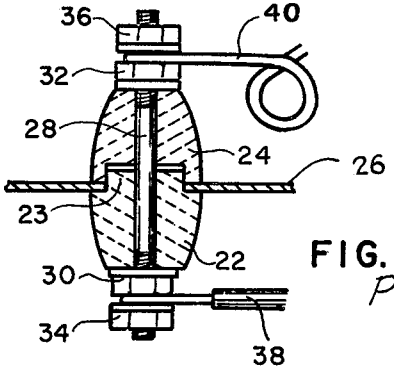
FIG. 4 Prior Art
FIG. 4 is a cross-sectional view of the corresponding prior art device.

A fuller appreciation of our novel device may be derived by next considering a typical prior art feedthrough device as shown in FIG. 4. There a first insulator member 22 is disposed on one side of a panel 26, and a mating insulator member 24 is on the opposite side of the panel, with a protuberance 23 disposed on one of these members, such as the member 22, with this protuberance fitting more or less snugly in a hole in the panel 26. Aligned, comparatively small holes extend through central portions of insulator members 22 and 24, thus to permit a threaded stud 28 to extend upwardly through both of these members. It is the purpose in such an arrangement for the threaded stud 28 to serve as a current-carrying member that is suitably insulated from contact with the panel 26 by the members 22 and 24.

The prior art arrangement of FIG. 4 would not be able to serve as an integral unit without the utilization of a suitable number of nuts threaded onto opposite ends of the stud 28. On the lower end of stud 28, a first nut 30 serves to bear against a washer adjacent the end of insulator 22, and a nut 32 on the upper end of the stud bears against a washer adjacent the upper end of the insulator member 24, thus to hold these components in assembled relation. Inasmuch as it is the purpose of this device to enable connections to be made such that current can be carried from one side of the panel to the other, a second lower nut 34 is used on the lower end of the stud 28 so that a loop formed in the end of the conductor of an insulated wire 38 may be held tightly, thereby to form an appropriate electrical connection. Similarly, a second upper nut 36 is utilized on the upper end of stud 28 in order to secure the looped end of a filament 40 in a proper electrical connection. The result of this arrangement is that electrical power supplied on wire 38 is able to cause the heating of filament 40.

Unfortunately, a prior art arrangement of this type has many disadvantages, with the most obvious one being that the person concerned with assembling the device must work with discrete devices rather than a subassembly. It is to be realized that if the insulators 22 and 24 were placed on the threaded stud, with these being followed by nuts threaded onto the ends of the stud, neither of the insulator members could be inserted through the hole in the panel 26, for this hole is necessarily smaller than the outer dimensions of the insulator members.

It is also to be realized that to assemble these discrete components into the arrangement on the panel as shown in FIG. 4 is a painstaking endeavor, and if the nuts are tightened too tightly, cracking of the insulator members is a distinct possibility, whereas if the nuts are not tightened enough, an insufficient electrical connection between the wire 38 serving as the electrical supply and the filament 40 may result.

Additionally, at such time as repairs such as the replacement of filament 40 become involved, it is necessary for the worker to remove most if not all of the nuts from the threaded stud 28, which results in the worker needing to handle a number of discrete components, which may easily become lost or broken. Repairs are further complicated in the event the stud 28 is made of ordinary steel, for any rusting that has taken place greatly complicates the removal of the nuts, and accordingly jeopardizes the further usefulness of the comparatively fragile insulator members 22 and 24.

Figure 6:
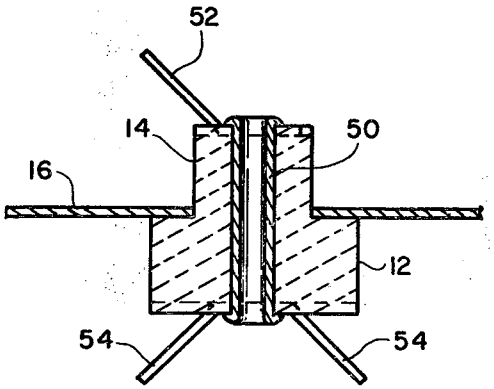
FIG. 6 is a view relatable to FIG. 5, but revealing an end view of our novel insulator assembly.
Figure 5:
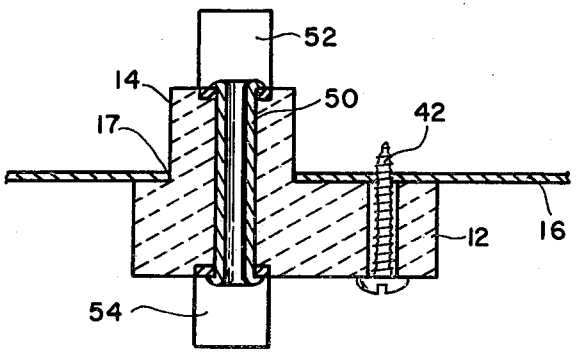
FIG. 5 is a cross-sectional view of an insulator assembly in accordance with our invention, shown in assembled relation to a panel.

FIGS. 5 and 6 are cross sectional views revealing a novel insulator assembly in accordance with this invention. In FIG. 5, the upper portion of the base portion 12 of our novel insulator is brought into contact with the panel 16, with the hole 17 in the panel permitting the upstanding feedthrough portion 14 to extend through the panel and onto the other side thereof. The assembly is held in the desired relationship to the panel member 16 by means of a sheet metal screw 42, which is disposed in the hole 18 of the base member 12, with the upper threaded portion of the screw 42 threadedly engaging a small hole formed in the panel 16 adjacent the hole 17. As is obvious, the sheet metal screw not only serves to hold our novel insulator assembly against separation from the panel, but also it prevents twisting of the assembly in the panel, which would of course jeopardize the filament used therewith, which might easily be twisted sufficiently as to cause breakage thereof. In a preferred embodiment of our device, we form the upstanding feedthrough portion 14 of a non-circular configuration, such as a square configuration as shown, and then utilize a slightly larger, closely-fitting hole in the panel 16 into which the portion 14 extends. In that way, undesirable rotation of the assembly in the panel is made impossible.

It is an important goal of our invention to provide an insulator arrangement that is pre-assembled in such a way as to require a minimum of effort on the part of the person assigned to build the heater or other electrical component making use of our invention. To that end, we utilize a metal current-carrying member 50 disposed in the hole 20 through the upstanding feedthrough portion 14, with the upper and lower ends of the member 50 serving to hold a suitable upper tab 52, such as a connector tab, in place, as well as a pair of lower tabs 54 of similar construction in operative positions, as shown in FIG. 6. A double lower tab arrangement is used to facilitate parallel connections to multiple filaments. Although the connector member 50 could be solid, we prefer for it to be in the form of a metal eyelet, which not only means that the tabs 52 and 54 can be secured in place easily by an appropriate rolling over of the ends of the eyelet, but also the hollow eyelet, when compressive force is applied to its upper and lower ends during the tab attachment procedure, does not enlarge at its mid portion so as to cause a cracking of the comparatively brittle ceramic.

As will be noted from FIG. 5, the lower tab 54 visible in this figure is of a width dimension corresponding to the width of the slot 21 across the bottom of the insulator, which of course prevents the pair of tab members 54 from undertaking undesirable rotational movements. We may prefer to use a unitary dual tab member on the bottom of the insulator body. A slot similar 21 may be used across the upper portion of the upstanding feedthrough member to serve as a locator for the upper tab 52, and likewise to prevent undesirable rotation of this member.

Although we are not to be limited to insulator members of any certain dimensions, in a preferred embodiment of our invention, the base or body member was approximately four-tenths of an inch thick, with the upstanding feedthrough member standing four-tenths of an inch above the base portion. The feedthrough member in the exemplary embodiment was one-half inch on a side, and the base member had an overall length of 1.3 inches.

It is therefore to be seen that we have provided a novel pre-connected insert assembly that greatly simplifies the procedure of connecting power through a wall or panel of an electrical device in an entirely safe and rapid manner, thus to bring about electrical power being applied to the filaments or other electrical components inside the device, without risking the grounding of the electrical components. Because our novel assembly utilizes an upstanding feedthrough member that can be readily inserted through a prepared hole in a panel, it is but a simple matter to connect electrical power to the filaments of the device, without the worker concerned with the manufacture of the device needing to painstakingly assemble numerous small, discrete components into a feedthrough arrangement for carrying current to the filaments of the device.

We claim:

1. A pre-assembled pass-through bushing unit for conducting electricity from one side to the other of an electrically conducting partition having an opening therein comprising:

an insulator device having a main body and an integral feedthrough portion extending outwardly of said main body, said portion being sized to fit through the opening in the partition;

means defining a bore extending completely through said main body and feedthrough portion;

connector means positioned at each end of said bore and having openings aligned therewith;

locking means on said insulator device adjacent opposite ends of said bore cooperating with said connector means to prevent rotation of said connector means with respect to each other and said device;

a hollow conductor snugly received within said bore and said connector openings and having its opposite ends deformed over said connector means to form a rigid unitary assembly; and means for rigidly removably attaching said device to the partition.

* * * * *